US009204677B2

(12) United States Patent
Abbey et al.

(10) Patent No.: US 9,204,677 B2
(45) **Date of Patent: *Dec. 8, 2015**

(54) NECK PROTECTION DEVICE

(71) Applicants: Joshua D. Abbey, Valley Stream, NY (US); Raphael P. Davis, Port Jefferson, NY (US); Craig D. Robertson, Port Jervis, NY (US)

(72) Inventors: Joshua D. Abbey, Valley Stream, NY (US); Raphael P. Davis, Port Jefferson, NY (US); Craig D. Robertson, Port Jervis, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/514,595

(22) Filed: Oct. 15, 2014

(65) Prior Publication Data

US 2015/0089720 A1 Apr. 2, 2015

Related U.S. Application Data

(63) Continuation-in-part of application No. 13/904,106, filed on May 29, 2013.

(51) Int. Cl.
*A42B 3/04* (2006.01)

(52) U.S. Cl.
CPC ..... *A42B 3/0473* (2013.01)

(58) Field of Classification Search
CPC ..... A42B 3/00; A42B 3/04; A42B 3/08; A42B 3/473; A63B 71/10; A63B 71/1291; A41H 1/04
USPC ..... 2/415, 410, 411, 412, 413, 425
See application file for complete search history.

(56) References Cited

U.S. PATENT DOCUMENTS

| | | | | |
|---|---|---|---|---|
| 3,230,544 | A * | 1/1966 | Mager | 2/415 |
| 4,319,362 | A * | 3/1982 | Ettinger | 2/415 |
| 2009/0022977 | A1* | 1/2009 | Dudley et al. | 428/323 |
| 2014/0352039 | A1* | 12/2014 | Abbey et al. | 2/421 |
| 2015/0089720 | A1* | 4/2015 | Abbey et al. | 2/411 |

* cited by examiner

*Primary Examiner* — Gloria Hale
(74) *Attorney, Agent, or Firm* — Sorrell, Lenna & Schmidt, LLP

(57) ABSTRACT

A device for use with a helmet in contact sports, which includes a curved body connected with the helmet and configured for disposal along a front part of a user's neck. The body includes: (i) planar first and second surfaces, the first surface defining a slot; and (ii) a third surface that is curved along the front part of the user's neck and configured to be spaced from but does not contact the user's neck. The device is configured to absorb an impact force and resist the user's neck from moving forward during a sports collision. Systems and methods are disclosed.

20 Claims, 10 Drawing Sheets

NECK PROTECTION DEVICE

CROSS-REFERENCE TO RELATED APPLICATION

This is a continuation-in-part of U.S. patent application Ser. No. 13/904,106 filed May 29, 2013, now pending, to which priority is claimed and which is herein incorporated by reference in its entirety.

TECHNICAL FIELD

The present disclosure generally relates to apparatus, systems and methods for neck protection, and more particularly, to a device for use with head equipment in athletics and/or other types of activities to prevent neck injuries.

BACKGROUND

Injuries can occur in activities, such as, for example, contact sports, snowmobile riding, motorcycle riding, automobile racing, go-cart riding, snowboarding, snow skiing, aircraft flying, bicycle riding, gymnastics and track. In contact sports, such as football, hockey and lacrosse, player injuries have increased despite players wearing protective equipment. In some cases, this can be due to limited options of protective gear that provide adequate protection without impacting the performance of a player. Moreover, efforts in helmet design, face guards and helmet suspensions have contributed somewhat to an increase in neck injuries as a result of the transfer of forces applied to the helmet directly onto the neck. Player injury has also increased because of player strength development and as a result, collisions occur in contact sports with greater impact and consequent danger.

Injuries to the neck are more frequently occurring in contact sports and typically can be serious and result in life-threatening and/or life-changing consequences. For example, brain and spinal cord damage can result from hyperflexion and/or hyperextension of the neck. These conditions usually occur as a result of a player's head being forced violently backward, forward, downward and/or to the side during a collision or other engagement with a player and/or ground surface. These instances of violent neck movement can sometimes be fatal and result in paralysis, fainting, weakness in the extremities, constant and intermittent pain and other physical deformities and/or conditions. In some cases, protective gear options, such as, for example, heavier helmets and neck collars have been used in an attempt to prevent such violent neck movement. This disclosure describes an improvement over these prior art technologies.

SUMMARY

New devices that are inexpensive to manufacture and easy-to-use that will absorb an impact force and prevent violent forward and downward neck movement during a sports collision are provided. One embodiment provides for a device for use with a helmet comprising a curved body being connected with the helmet and configured for disposal along a front part of a user's neck. The body includes: (i) planar first and second surfaces, said first surface defining a slot; and (ii) a third surface that is curved along the front part of the user's neck and configured to be spaced from the user's neck. The first surface has a slot to generally conform with a chin cup. The device is configured to absorb an impact force and resist the user's neck from moving forward during a collision. In some embodiments, systems and methods are provided.

In one embodiment of a device for use with a helmet in contact sports, a device is provided including a curved body being connected with the helmet and configured for disposal along a front part of a user's neck. The body includes: (i) flat first and second surfaces, said first surface defining an arcuate slot for disposal of a chin cup; (ii) a third surface that is curved along the front part of the user's neck and configured to be spaced near but does not contact the user's neck during normal use of the device; (iii) a fourth surface to absorb an impact force during a sports collision; and (iv) a connecting member extending from the chin cup and being configured to connect the device to the user's helmet including one or more of an adherent material, tape, glue and a Velcro-type fastener. The device is configured to absorb an impact force and restrict the user's neck from moving forward during a sports collision.

A protective apparatus for use in contact sports is also provided. The apparatus includes a helmet with a chin cup and a device including a curved body connected to the chin cup and configured for disposal along a front part of a user's neck. The body includes: (i) planar first and second surfaces; (ii) a third surface that is curved along the front part of the user's neck and configured to be spaced from but does not contact the user's neck during normal use of the device; and (iii) a fourth surface to absorb an impact force during sports collisions. The first surface defines a slot for disposal of the chin cup. The protective apparatus prevents an injury to the user's head and neck during sports collisions.

Additional features and advantages of various embodiments will be set forth in part in the description that follows, and in part will be apparent from the description, or may be learned by practice of various embodiments. The objectives and other advantages of various embodiments will be realized and attained by means of the elements and combinations particularly pointed out in the description and appended claims.

BRIEF DESCRIPTION OF THE DRAWINGS

In part, other aspects, features, benefits and advantages of the embodiments will be apparent with regard to the following description, appended claims and accompanying drawings where:

Figure 1:
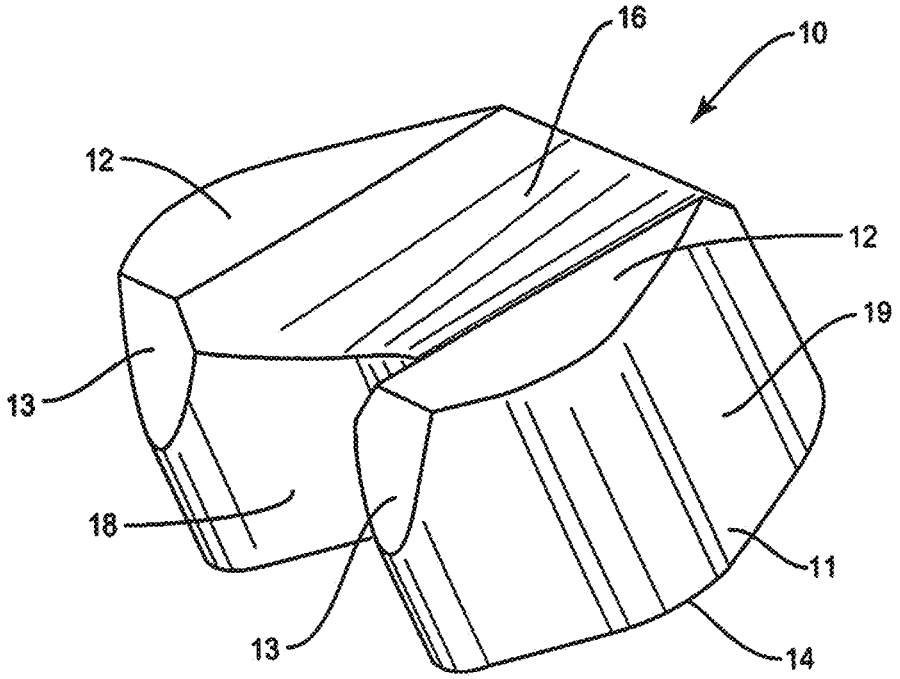
FIG. 1 is a perspective view of a component of one embodiment of a device in accordance with the principles of the present disclosure.
Figure 2:
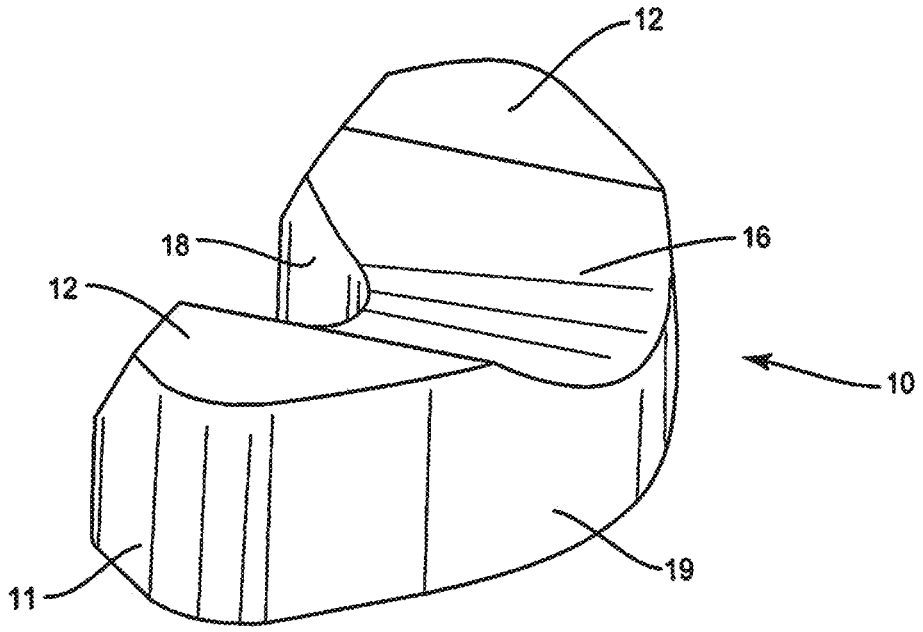
FIG. 2 is a perspective view of the component shown in FIG. 1.
Figure 3:
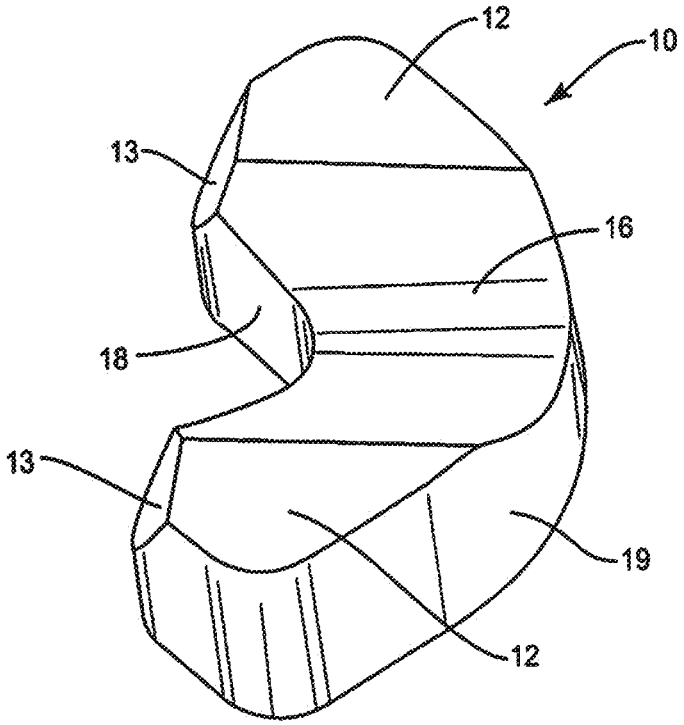
FIG. 3 is a perspective view of the component shown in FIG. 1.
Figure 4:
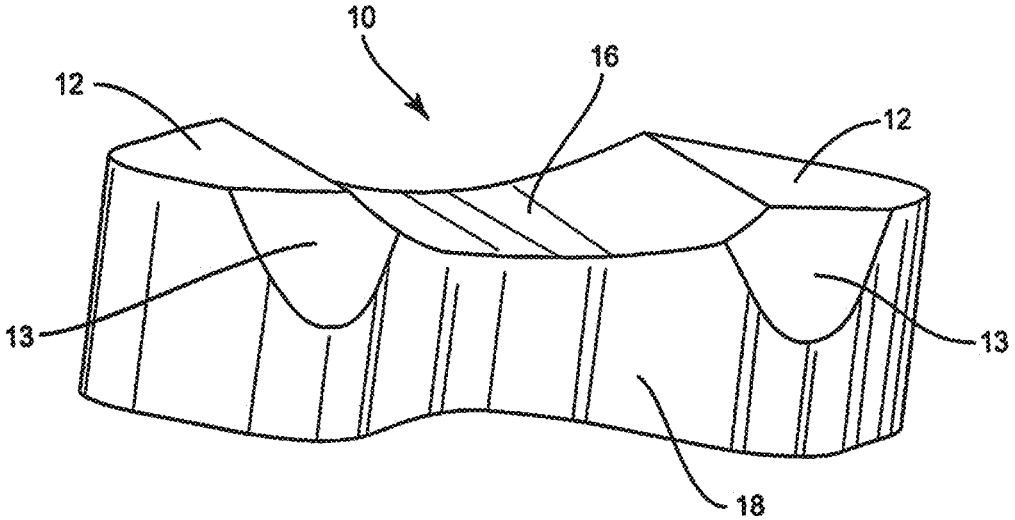
FIG. 4 is a perspective view of the component shown in FIG. 1.
Figure 5:
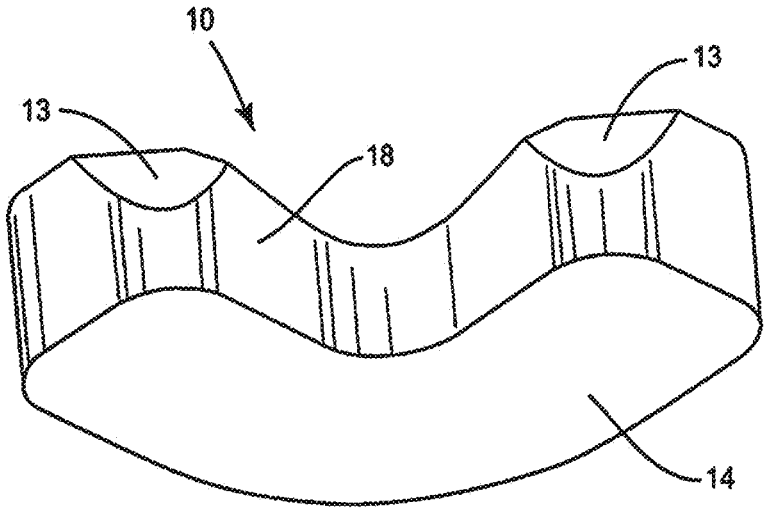
FIG. 5 is a perspective view of the component shown in FIG. 1.
Figure 6:
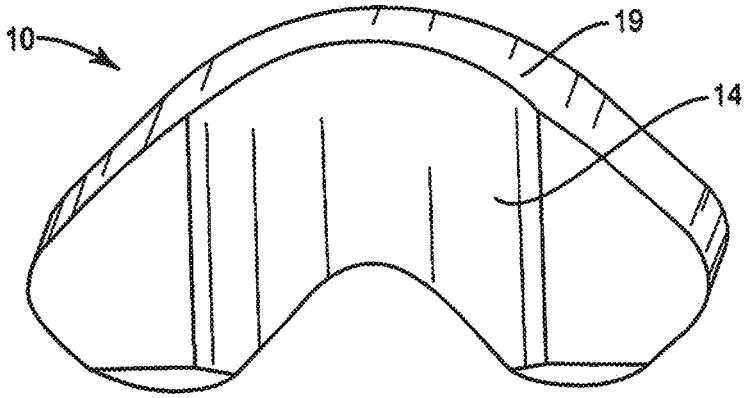
FIG. 6 is a perspective view of the component shown in FIG. 1.

It is to be understood that the figures are not drawn to scale. Further, the relation between objects in a figure may not be to scale, and may in fact have a reverse relationship as to size. The figures are intended to bring understanding and clarity to the structure of each object shown, and thus, some features may be exaggerated in order to illustrate a specific feature of a structure.

DETAILED DESCRIPTION

The exemplary embodiments of the present disclosure are discussed in terms of an apparatus, systems and methods for neck protection and more particularly, in terms of a system, method and device for use with head equipment in athletics and/or other types of activities to prevent neck injuries.

In one embodiment, the system of the present disclosure includes head equipment comprising a device having a protective configuration that avoids injury to a user by resisting and/or preventing violent forward and/or downward neck movement. In one embodiment, the device is configured to absorb shock and restrict movement forward and downward in a semi-circular arc trajectory toward a player's front body surface, such as, for example, a chest, clothing disposed with the chest and/or protective gear disposed with the chest, such as, for example, padding.

In one embodiment, the device includes a buffering polyfoam body configured to prevent forward movement of the chin directly toward the chest. In one embodiment, the device includes a stopping device that absorbs shock and limits range of motion of the head and neck during a collision to prevent the neck from snapping. In one embodiment, the device includes a body gear attached flush, via tape or Velcro® secured strapping, to a chin strap on both sides of a chin cup.

In one embodiment, the device includes straps that wrap in circumferential manner around a neck guard. In one embodiment, the device includes a body that travels with the chin such that the body is disposed in a position to buffer a hit that drives the head forward/downward or laterally forward. In one embodiment, the body curves in an arc underneath a jawbone for support. In one embodiment, the body is disposed in position to absorb a hit to a throat. In some embodiments, the configuration of the device does not obstruct a player's field of vision and/or does not restrict a range of athletic motion.

In one embodiment, the body has a flattened top surface and a flattened bottom surface. In some embodiments, the flattened bottom surface is configured to engage a breastplate of shoulder pads. In some embodiments, the top surface includes a surface that defines a recess conforming to a forward point of a chin cup. In some embodiments, the top surface includes a surface that defines a slot for seating the edge of a chin cup. In some embodiments, the device is employed with head equipment to reduce the risk and/or resist and prevent catastrophic injury.

In one embodiment, the body is fabricated from a closed cell cross-linked polyethylene foam, such as, for example, an ethylene vinyl acetate (EVA) foam, such that the body has a smooth surface with an extremely fine cell structure. In some embodiments, the body is fabricated from foam having a tough and firm configuration and an elastic characteristic.

In some embodiments, the device is configured for connection to an existing head equipment, such as, for example, an existing helmet without requiring any change and/or modification in helmet design.

In some embodiments, the device includes a body having a point of engagement that is on a breast plate of a shoulder pad and such engagement ranges wider laterally along the jaw bone's arc, to resist violent neck movement, as described herein, over a wider range of engagement and earlier in a process of a collision. In some embodiments, the device includes a body having an attachment zone that is connected with a chin cup such that the body travels with the trajectory of a chin and is configured to be disposed in position to prevent violent neck movement. In some embodiments, the device includes a body having an attachment zone that is connected with adhesive, such as, for example, tape to a chin cup and remains connected with the chin cup during athletic movement.

In some embodiments, the device includes a body disposed directly under a chin. In some embodiments, the device includes a body having a flat bottom that captures a flat surface of a shoulder pad breast plate, which may be covered by clothing, such as, for example, a jersey, with more surface contact, and less neck movement or travel. In some embodiments, the device includes a body having an arc extending along a jawbone. In some embodiments, the device includes a body ergonomically designed for player comfort and avoids contact with a player's throat. In some embodiments, the device includes a body configured to provide concussion protection via chin padding. This configuration provides concussion protection from hits traveling up the body toward the head of a player when the chin is hit violently from below, and/or players contacting the ground, such that the device is disposed in position to absorb shock.

The present disclosure may be understood more readily by reference to the following detailed description of the disclosure taken in connection with the accompanying drawing figures, which form a part of this disclosure. It is to be understood that this disclosure is not limited to the specific devices, methods, conditions or parameters described and/or shown herein, and that the terminology used herein is for the purpose of describing particular embodiments by way of example only and is not intended to be limiting of the claimed disclosure. Also, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. It is also understood that all spatial references, such as, for example, horizontal, vertical, top, upper, lower, bottom, left and right, are for illustrative purposes only and can be varied within the scope of the disclosure. For example, the references "upper" and "lower" are relative and used only in the context to the other, and are not necessarily "superior" and "inferior". For example, reference to "a device" can include one, two, three or more devices.

Notwithstanding that the numerical ranges and parameters setting forth the broad scope of the present disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub ranges subsumed therein. For example, a range of "1 to 10" includes any and all sub ranges between (and including) the minimum value of 1 and the maximum value of 10, that is, any and all sub ranges having a minimum value of equal to or greater than 1 and a maximum value of equal to or less than 10, e.g., 5.5 to 10.

The following discussion includes a description of a system, method and device for use with protective gear and head equipment in athletics and/or other types of activities to prevent neck injuries in accordance with the principles of the present disclosure. Alternate embodiments are also disclosed. Reference will now be made in detail to the exemplary embodiments of the present disclosure, which are illustrated in the accompanying figures. Turning to FIGS. 1-6, there are illustrated components of a neck protection system comprising a protective neck device 10. While the present disclosure is described in conjunction with the illustrated embodiments, it will be understood that they are not intended to limit the present disclosure to those embodiments. On the contrary, the present disclosure is intended to cover all alternatives, modifications and equivalents which may be included within the present disclosure as defined by the appended claims.

The components of the neck protection system can be fabricated from materials suitable for use with head equipment in athletics and/or other types of activities to prevent neck injuries, including metals, synthetic polymers, ceramics, and/or their composites. For example, the components of the neck protection system, individually or collectively, can be fabricated from materials such as stainless steel alloys, titanium alloys, cobalt-chrome alloys, super elastic metallic alloys (e.g., Nitinol, super elasto-plastic metals, such as GUM METAL® manufactured by Toyota Material Incorporated of Japan), thermoplastics such as polyaryletherketone (PAEK) including polyetheretherketone (PEEK), polyetherketoneketone (PEKK) and polyetherketone (PEK), carbon-PEEK composites, polyethylene terephthalate (PET), fabric, silicone, polyurethane, silicone-polyurethane copolymers, polymeric rubbers, polyolefin rubbers, semi-rigid and rigid materials, elastomers, thermoplastic elastomers, thermoset elastomers, elastomeric composites, rigid polymers including polyphenylene, polyamide, polyimide, polyetherimide, polyethylene, epoxy, and their combinations. Various components of the neck protection system may have material composites, including the above materials, to achieve various desired characteristics such as strength, rigidity, elasticity, compliance, and durability. The components of the neck protection system, individually or collectively, may also be fabricated from a heterogeneous material such as a combination of two or more of the above-described materials. The components of the neck protection system may be monolithically formed, integrally connected or include fastening elements and/or instruments, as described herein.

Figure 8:
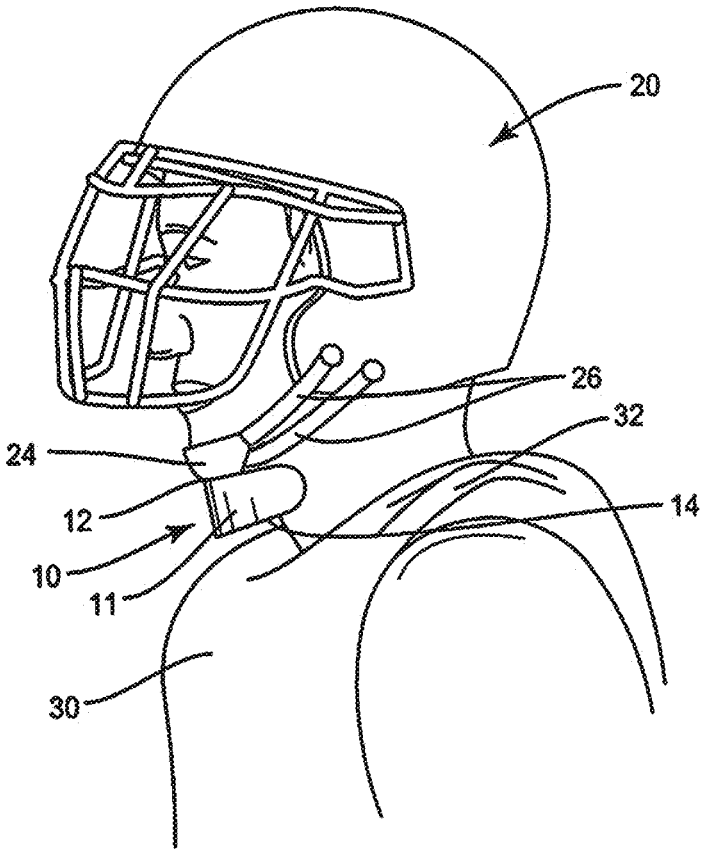
FIG. 8 is a side perspective view of the device and user body shown in FIG. 7.
Figure 9:
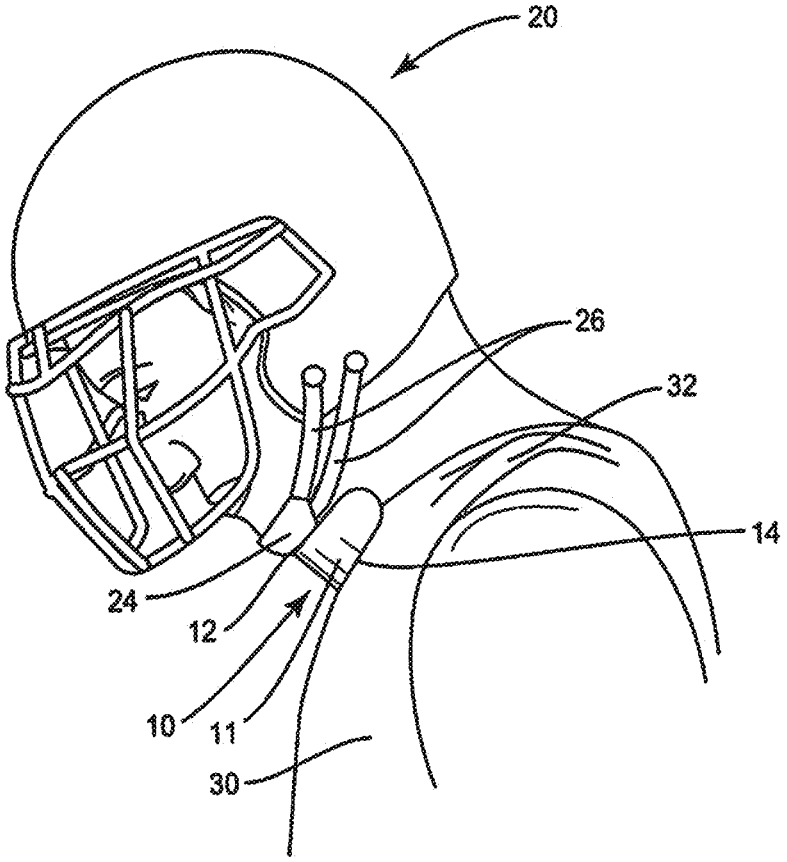
FIG. 9 is a side perspective view of the device and user body shown in FIG. 7.

The neck protection system includes head equipment, such as, for example, a football helmet, as described herein. The football helmet has a chin cup that is connected with device 10 in a protective configuration that avoids injury to a user by resisting and/or preventing violent forward and/or downward neck movement of a user wearing the helmet between a first, non-collision orientation, as shown in FIG. 8, and a second, collision orientation, as shown in FIG. 9.

Device 10 comprises a body 11 having a curved shape configured for disposal along a front part of a user's neck. Device 10 includes a planar or flat upper surface 12 having a curved portion 16 to generally conform device 10 to the underside of a user's chin during use. Surface 12 has a beveled portion 13 at each of its ends to facilitate conformance of body 11 with a user's jaw. In some embodiments, all or only a portion of body 11 may have alternate axial and/or cross section configurations, such as, for example, oval, oblong, triangular, square, polygonal, irregular, uniform, non-uniform, offset, staggered, undulating, arcuate, variable and/or tapered. In some embodiments, all or only a portion of surface 12 may have alternate surface configurations such as, for example, rough, arcuate, undulating, mesh, porous, semi-porous, dimpled and/or textured.

Device 10 includes a lower surface 14, which substantially contacts a user's chest area, which may include clothing and/or padding during a sports collision. Surface 14 of device 10 is substantially planar or flat. In some embodiments, all or only a portion of surface 14 may have alternate surface configurations to enhance engagement, fixation and/or capturing of the user's chest area, such as, for example, rough, arcuate, undulating, mesh, porous, semi-porous, dimpled and/or textured.

In some embodiments, during use of device 10 and during a collision, surface 14 substantially contacts a user's shoulder protective gear and resists and/or prevents a user's neck from moving forward and/or downward during the collision. In some embodiments, surface 14 has a zone of engagement engageable with a breast plate of a shoulder pad and such engagement ranges wider laterally along the jaw bone's arc to resist violent neck movement, as described herein, over a wider range of engagement and earlier in a process of a collision. This configuration of body 11 such that surface 14 engages the breast plate includes a stopping configuration that absorbs shock and limits range of motion of the head and neck during a collision.

Device 10 includes a third or inner surface 18 that is curved and configured to be spaced from but does not contact a user's neck during normal use. Device 10 has a fourth or outer surface 19. In some embodiments, all or only a portion of surfaces 18, 19 may have alternate surface configurations, such as, for example, rough, arcuate, undulating, mesh, porous, semi-porous, dimpled and/or textured.

Figure 7:
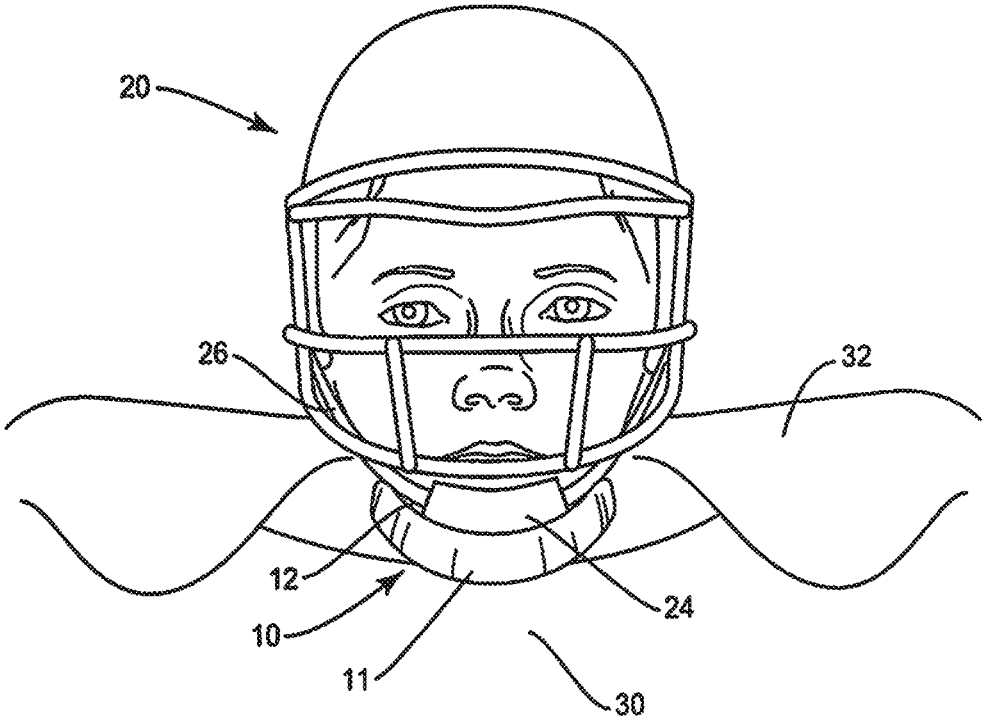
FIG. 7 is a perspective view of components of one embodiment of a system a device in accordance with the principles of the present disclosure disposed with a user body.

In one embodiment, as shown in FIGS. 7-9, the neck protection system comprises device 10, similar to the systems, devices and methods described above with regard to FIGS. 1-6, which includes body 11 connected to head equipment, such as, for example, a chin cup 24 connected via chin straps 26 to a football helmet 20 adjacent a front portion of surface 12. Body 11 is directly connected solely and/or exclusively to chin cup 24 along an attachment zone such that body 11 travels with the trajectory of a chin and is configured to be disposed in position to prevent violent neck movement. In some embodiments, body 11 is not directly connected to helmet 20 and/or straps 26 to avoid undesired movement of device 10 corresponding to motion of helmet 20. In some embodiments, body 11 is monolithically formed with chin cup 24. In some embodiments, chin cup 24 may be attached to surface 12 via a connecting member (not shown). In some embodiments, the connecting member may include adhesive tape.

Helmet 20 has chin cup 24 connected with body 11 in a protective configuration that avoids injury to a user by resisting and/or preventing violent forward and/or downward neck movement of a user wearing helmet 24 between a first, non-collision orientation, as shown in FIG. 8, and a second, collision orientation, as shown in FIG. 9. In the non-collision orientation, surface 14 of body 11 is spaced apart from a breast plate 30 of shoulder pads 32 worn by the user.

In a collision of the user during a sports activity, body 11 rotates about the user's body in a semi-circular arc trajectory toward a player's front body surface and breast plate 30 such that body 11 travels with the chin such that body 11 is disposed in a position to buffer a hit that drives the user's head forward/downward and/or laterally forward. Device 10 is configured to absorb shock and resist and/or prevent neck movement forward and downward. In the collision orientation, surface 14 engages breast plate 30 in a stopping configuration to absorb shock and limit range of motion of the head and neck during the collision.

In some embodiments, device 10 can be used with various types of helmets. such as, for example, hockey helmets. lacrosse helmets, baseball helmets, equestrian helmets; occupational helmets such as hard hats, riot helmets, military helmets; and recreational helmets. such as climbing helmets, bike helmets, ski helmets, motorcycle helmets and/or racing helmets.

Figure 10:
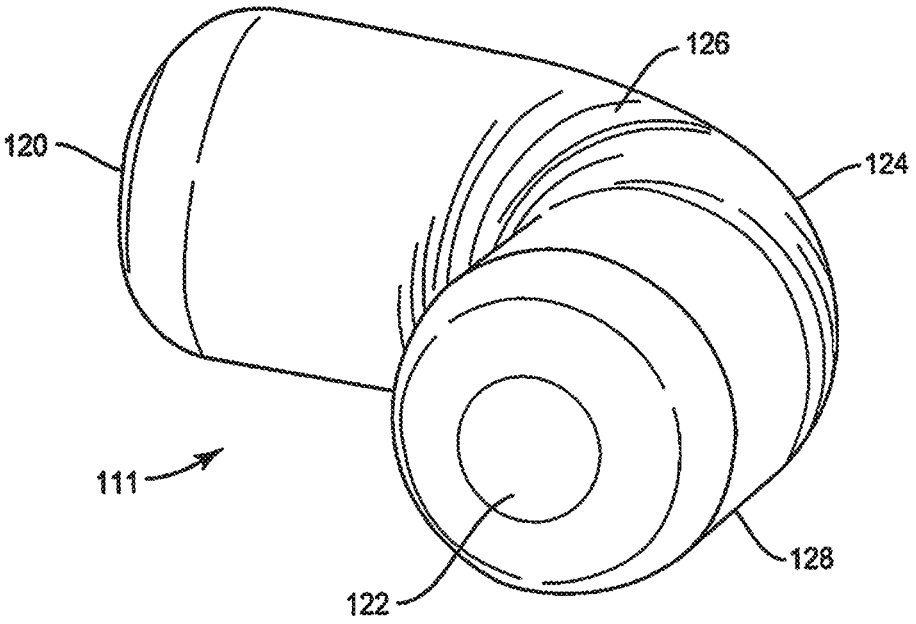
FIG. 10 is a perspective view of a component of one embodiment of a device in accordance with the principles of the present disclosure.
Figure 11:
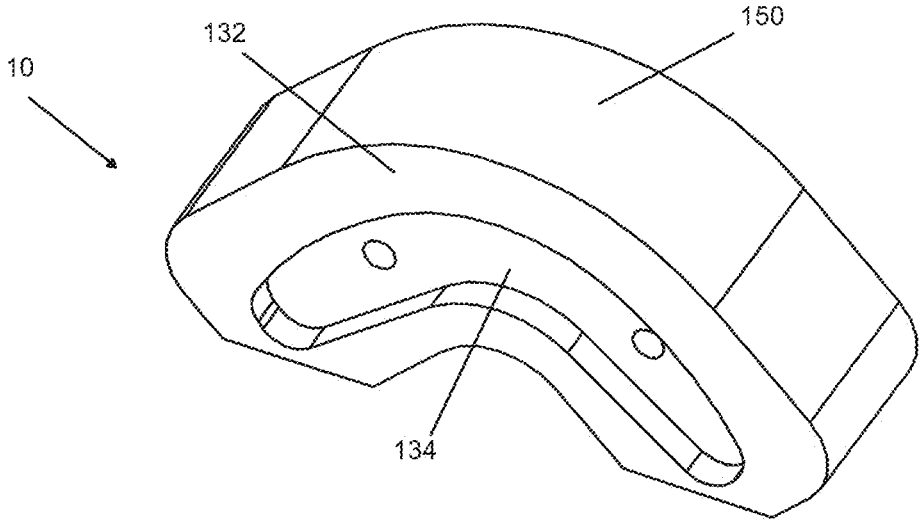
FIG. 11 is a perspective view of a component of one embodiment of a device in accordance with the principles of the present disclosure.
Figure 12:
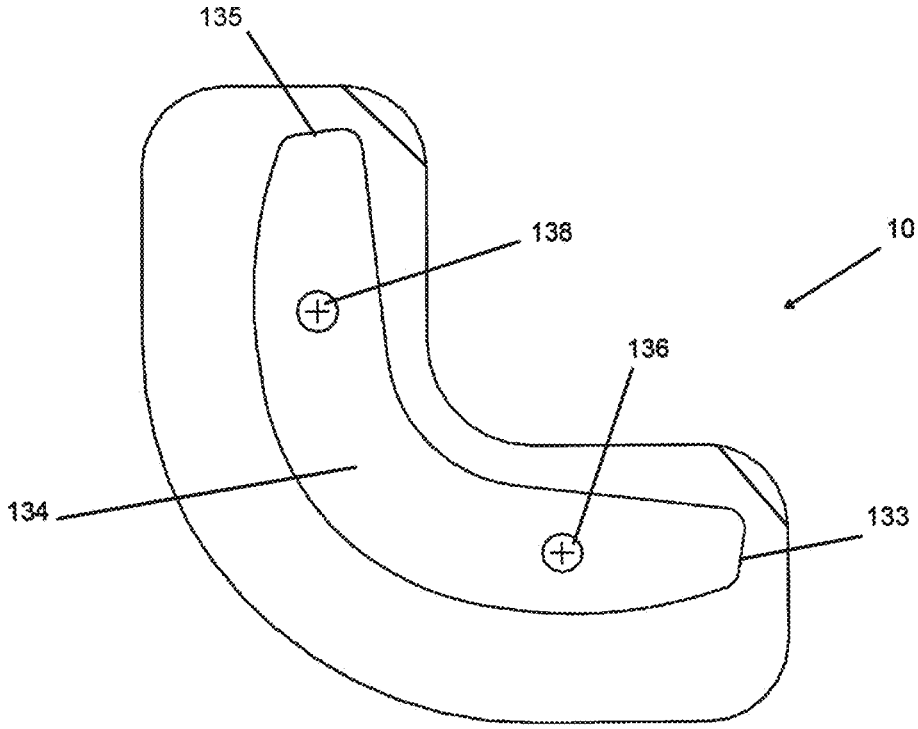
FIG. 12 is a top view of the component shown in FIG. 11.
Figure 13:
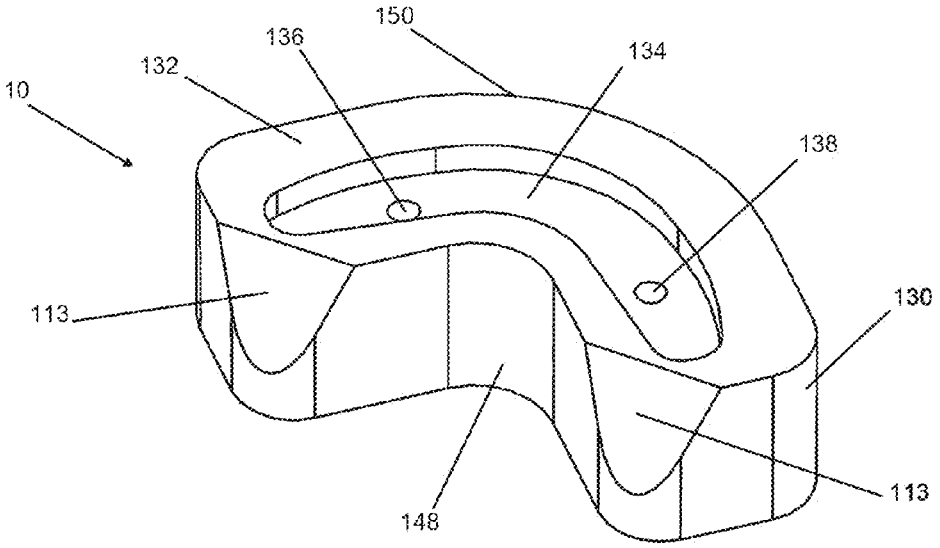
FIG. 13 is a perspective view of the component shown in FIG. 11.
Figure 14:
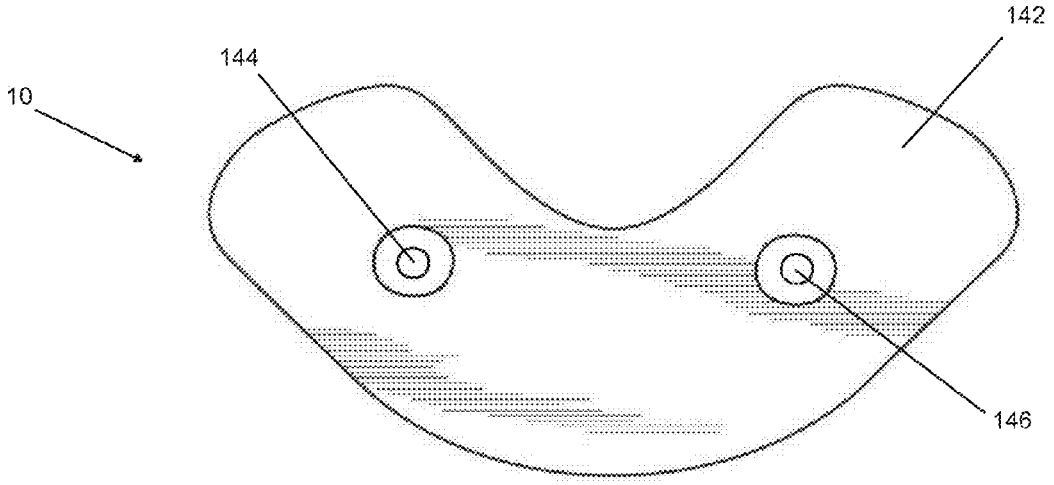
FIG. 14 is a bottom view of the component shown in FIG. 11.
Figure 15:
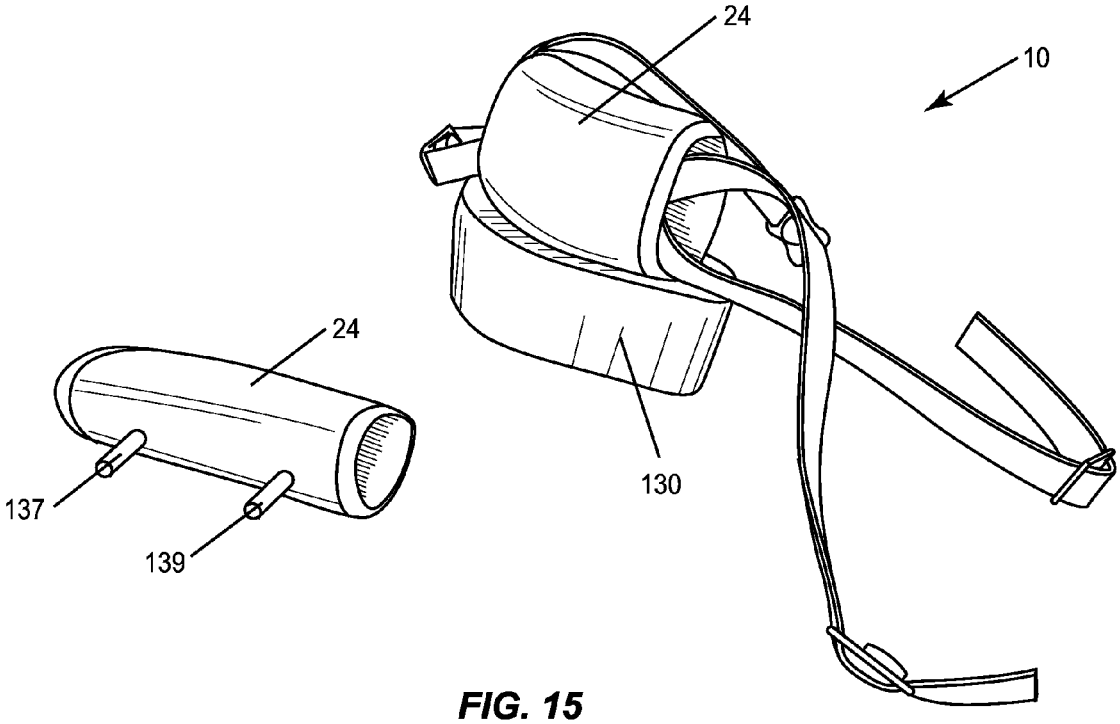
FIG. 15 is a perspective view of the component shown in FIG. 11.
Figure 16:
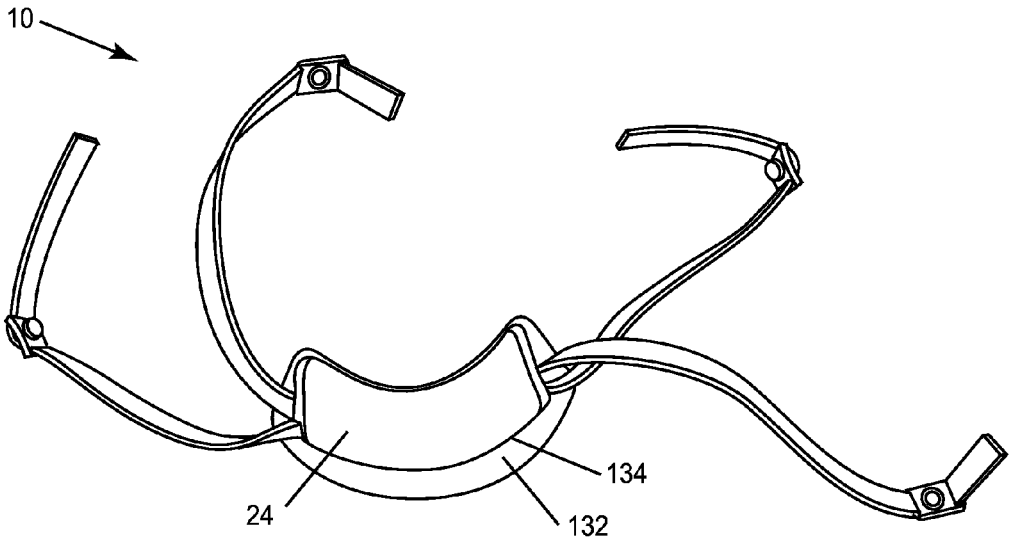
FIG. 16 is a top view of the component shown in FIG. 11.

In one embodiment, as shown in FIG. 10, the neck protection system comprises device 10, similar to the systems, devices and methods described above with regard to FIGS. 1-6, which includes a body 111 configured for connection to head equipment similar to that described herein. Body 111 has a cylindrical cross section configuration and extends between an end 120 and an end 122. End 120 has a planar face and end 122 has a planar face. Body 111 includes an arcuate intermediate portion 124 such that body 111 extends in a linear configuration to ends 120, 122, respectively.

Body 111 includes an outer surface that defines a top surface 126 connected with a chin cup of a helmet, similar to that described herein, such that body 111 travels with the trajectory of a chin and is configured to be disposed in position to prevent violent neck movement. Body 111 includes an outer surface that defines a bottom surface 128 that is engageable with a chest surface, similar to that described herein, in a stopping configuration to absorb shock and limit range of motion of the head and neck during the collision. As such, body 111 is disposable in a protective configuration that avoids injury to a user by resisting and/or preventing violent forward and/or downward neck movement of a user wearing a helmet between a first, non-collision orientation and a second, collision orientation, as described herein.

In one embodiment, as shown in FIGS. 11-16, the neck protection system comprises device 10, similar to the systems, devices and methods described above with regard to FIGS. 1-6 and 7-9, which includes a body 130 having a curved shape configured for disposal along a front part of a user's neck. Device 10 includes a planar or flat upper surface 132 defining a slot 134 to generally conform, connect and/or attach device 10 to the underside of chin cup 24 during use. Slot 134 comprises a first end portion 133 and a second end portion 135 defined by surface 132. In one embodiment, slot 134 includes a first opening 136 and a second opening 138 configured for disposal and/or engagement with fixation elements, such as, for example, dowels 137, 139 disposed on an outer surface of chin cup 24. The engagement of openings 136, 138 with dowels 137, 139 of chin cup 24 create a fixed engagement such that device 10 is locked with chin cup 24 during use. In one embodiment, slot 134 is recessed from surface 132. In some embodiments, slot 134 has an arcuate configuration. In alternative embodiments, slot 134 has an oval, oblong, irregular, uniform, non-uniform, variable and/or tapered configuration. In some embodiments, all or only a portion of body 130 may have alternate axial and/or cross section configurations, such as, for example, oval, oblong, triangular, square, polygonal, irregular, uniform, non-uniform, offset, staggered, undulating, arcuate, variable and/or tapered. In some embodiments, all or only a portion of surface 132 may have alternate surface configurations such as, for example, rough, arcuate, undulating, mesh, porous, semi-porous, dimpled and/or textured.

Device 10 includes a lower surface 142, which substantially contacts a user's chest area, which may include clothing and/or padding during a sports collision. Surface 142 of device 10 is substantially planar or flat. In one embodiment, surface 142 includes an insert 144 and an insert 146 disposed within openings 136, 138 respectively. In one embodiment, inserts 144, 146 are configured for engagement with dowels 137, 139. In some embodiments, all or only a portion of surface 142 may have alternate surface configurations to enhance engagement, fixation and/or capturing of the user's chest area, such as, for example, rough, arcuate, undulating, mesh, porous, semi-porous, dimpled and/or textured. In some embodiments, body 130 includes beveled portions 113, similar to portions 13 described herein, at each of its ends.

In some embodiments, during use of device 10 and during a collision, surface 142 substantially contacts a user's shoulder protective gear and resists and/or prevents a user's neck from moving forward and/or downward during the collision. In some embodiments, surface 142 has a zone of engagement engageable with a breast plate of a shoulder pad and such engagement ranges wider laterally along the jaw bone's arc to resist violent neck movement, as described herein, over a wider range of engagement and earlier in a process of a collision. This configuration of body 130 such that surface 142 engages the breast plate includes a stopping configuration that absorbs shock and limits range of motion of the head and neck during a collision.

Device 10 includes a third or inner surface 148 that is curved and configured to be spaced from but does not contact a user's neck during normal use. Device 10 has a fourth or outer surface 150. In some embodiments, all or only a portion of surfaces 148, 150 may have alternate surface configurations, such as, for example, rough, arcuate, undulating, mesh, porous, semi-porous, dimpled and/or textured.

In some embodiments, the connecting member can include one or more of an adherent material, tape, glue and/or a Velcro-type fastener. The adherent material can include one or more of a cellophane, vinyl, acetate, polyethylene acrylic, butyl rubber, ethylene-vinyl acetate, natural rubber, a nitrile, silicone rubber, a styrene block copolymer, a vinyl ether and/or a tackifier. The adherent material can further include an antimicrobial and/or antiseptic material. Antiseptic materials that can be used include but are not limited to: alcohols such as ethanol, 1-propanol and 2-propanol/isopropanol or mixtures of these alcohols; sodium bicarbonate; hydrogen peroxide; benzalkonium chloride; chlorhexidine; hexachlorophene; iodine compounds and combinations thereof. Antimicrobial materials that can be used include but are not limited to: beta-lactam antibiotics (such as penicillins, cephalosporins); protein synthesis inhibitors (such as aminoglycosides, macrolides, tetracyclines, chloramphenicol, polypeptides); sulphonamides; cotrimoxazole; quinolones; anti-viral agents; anti-fungal agents; anti-cancer drugs; anti-malarial drugs; anti-tuberculosis drugs; anti-leprotic drugs; anti-protozoal drugs; and combinations thereof.

The helmet of the user in various embodiments can include a chin strap and the connecting member attaches the device to a part of the chin strap that is shaped and configured to fit around the user's chin. This part of the chin strap can have the shape of a cup fitting around the user's chin. In some embodiments, the chin strap is adjustable such that the length of the strap can be changed depending on the needs of the user. In one embodiment, the connecting member includes straps with Velcro fasteners at each end and the straps are wrapped circumferentially around the device and the cup part of the chin strap. In one embodiment, the connecting member includes tape that securely attaches device 10 to the outer surface of the cup part of the chin strap.

In some embodiments, the helmet of the user includes a face mask and a connecting member that attaches the device to the face mask. In one embodiment, the connecting member includes straps with Velcro fasteners at each end and the straps wrap circumferentially around the device and a portion of face mask. In one embodiment, the connecting member includes tape that securely attaches the device to a portion of the face mask.

In various embodiments, the connecting member that connects the device to a user's helmet includes a strap housed within a cavity formed within and through the curved body of the device. The cavity can also be formed along the first surface of the device. The strap can include fasteners at both of its ends and the strap can be secured or attached around a chin strap or face mask of a helmet using the fasteners. In some embodiments, the fasteners can include hook/loop closures, grommets, buttons, rivets, tacks, staples, screws, buckles, tab snaps/snap receptacles and/or clips. In some embodiments, the connecting member that connects the device to a user's helmet includes two or more straps housed within one or more cavities formed within and through the curved body of the device.

The devices in various embodiments can be re-used as needed. The dimensions of devices can vary depending on the size of the user. Generally, devices will have dimensions to conform to the size of a neck of a youth and adult and will provide maximum protection to the user without adversely interfering with the performance of the user. With respect to the length of the devices, in various embodiments, the devices have a length in the range of from about 1 inch to about 12 inches. In some embodiments, the devices have a length in the range of from about 4 inches to about 8 inches.

With respect to the diameter or perimeter across the devices, the dimensions will vary depending upon the neck size of the targeted user. In various embodiments, the diameter is in the range of from about 1 to about 6 inches. In some embodiments, the diameter is in the range of from about 1 to about 2 inches. In various embodiments, the device can be manufactured using any of a variety of suitable processes, including single shot injection molding, multiple shot injection molding and thermoforming.

In some embodiments, device 10 can be coated or sprayed with an antimicrobial and/or antiseptic material. Antiseptic materials that can be used include but are not limited to: alcohols such as ethanol, 1-propanol and 2-propanol/isopropanol or mixtures of these alcohols; sodium bicarbonate; hydrogen peroxide; benzalkonium chloride; chlorhexidine; hexachlorophene; iodine compounds and combinations thereof. Antimicrobial materials that can be used include but are not limited to: beta-lactam antibiotics (such as penicillins, cephalosporins); protein synthesis inhibitors (such as aminoglycosides, macrolides, tetracyclines, chloramphenicol, polypeptides); sulphonamides; cotrimoxazole; quinolones; anti-viral agents; anti-fungal agents; anti-cancer drugs; anti-malarial drugs; anti-tuberculosis drugs; anti-leprotic drugs; anti-protozoal drugs and combinations thereof.

In some embodiments, device 10 includes a resilient material, such as, for example, those resilient material examples described above, to absorb the impact of a force during a sports collision and then to return to its normal condition. The resilient material selected should have a sufficient density and resiliency to adequately perform in its role of protecting the neck. In some embodiments, the material may be elastic compressible or more rigid, depending on the desired characteristics. In various embodiments, the resilient material includes one or more of a polyethylene foam, rubber, a cross-linked polyethylene foam, a polypropylene foam, synthetic rubber polyurethane, a polyurethane foam, a polystyrene foam, a gel-foam polyurethane and silicone.

Polyurethane foam may be from a reaction between a polyether or a polyester, and a suitable aromatic diisocyanate, such as 4'4' diphenylmethane diisocyanate (sold by Mobay Chemical Corp. under the tradename Mondur CD). A polyether can be used to form a polyurethane foam since it is less hygroscopic and it does not require the use of elevated temperatures such as may be necessary to process polyesters. One example of a polyether is sold by Mobay Chemical Corp. under the trade designation NB 337230E (typical spec. molecular wt. 4000; Hydroxil No. 28; Acid No. 1; Free foam density 0.2; Stoichimetric ratio OH-1 NCO.1; Actual Ratio OH-1 NCO 1.1). Cross-linked polyethylene foam is available from multiple companies including UFP Technologies, Inc., 172 E Main Street, Georgetown, Mass. 01833 and Foam Factory, 22800 Hall Road, Clinton Township, Mich. 48036.

In some embodiments, the resilient material can include one or both of the closed cell cross-linked polyethylene foams known as EV-20 and EV-30. EV-20 (density of 2, compression strength at 25% psi of 4 and 50% psi of 9, tensile strength of 40 psi and tear resistance of 6 lbs./inch) and EV-30 (density of 3, compression strength at 25% psi of 5 and 50% psi of 12, tensile strength of 70 psi and tear resistance of 8 lbs./inch) are both available from Zotefoams plc, 675 Mitcham Road, Croydon, Surrey CR9 3AL England.

In some embodiments, the resilient material can further include an antimicrobial and/or antiseptic material. Antiseptic materials that can be used include but are not limited to: alcohols such as ethanol, 1-propanol and 2-propanol/isopropanol or mixtures of these alcohols; sodium bicarbonate; hydrogen peroxide; benzalkonium chloride; chlorhexidine; hexachlorophene; iodine compounds and combinations thereof. Antimicrobial materials that can be used include but are not limited to: beta-lactam antibiotics (such as penicillins, cephalosporins); protein synthesis inhibitors (such as aminoglycosides, macrolides, tetracyclines, chloramphenicol, polypeptides); sulphonamides; cotrimoxazole; quinolones; anti-viral agents; anti-fungal agents; anti-cancer drugs; anti-malarial drugs; anti-tuberculosis drugs; anti-leprotic drugs; anti-protozoal drugs and combinations thereof.

In some embodiments, device 10 can include a covering to provide additional strength to the device. The covering can be made of various materials that absorb the impact of a force during a sports collision such as vinyl materials. In one embodiment, the covering includes a shock-absorbing layer constructed of a material having shock absorbing properties such as EVA. In some embodiments, the covering can include an antimicrobial and/or antiseptic material coated or spray-dried on its outer surface. In various embodiments, the covering can provide protection to the exterior surface of the device. In some embodiments, the covering comprises a porous woven cloth material that acts as a pocket for the device to be disposed therein. In some embodiments the woven cloth material may alternatively be knitted, stitched, or sewed. In various embodiments, the covering comprises fabrics that can be selectively resilient or have a limited capability to be stretched so as to accommodate conformance of the device when the device is compressed or otherwise deformed during usage. In some embodiments, the woven cloth material may be a light weight nylon, polyester, wool, or cotton canvas type material.

In various embodiments, the covering may be made from a moisture wicking fabric material The moisture wicking fabric material is hydrophobic to repel water from the skin because of water's tendency toward capillary-action, which draws moisture through openings in micro-fibers of said moisture wicking fabric material. Such fabric material may also be employed to regulate a user's temperature. For example, if a user starts to sweat, then said moisture wicking fabric material will draw moisture through the fabric material away from a user's skin, which facilitates evaporation of the moisture and produces a cooling effect.

In various embodiments, device 10 may have a plurality of openings therethrough to help absorb shock from an impact force by enhancing the flexibility of device 10. The plurality of openings can be of various shapes and sizes. For example, the openings can be in form of a square, a circle, a rectangle, an oval, a polygon, a cut, a slit, a rectangular slot or the like. Various shapes and sizes of the openings can enable a desired level of lateral and/or longitudinal flexibility of device 10 thereby increasing the ability of device 10 to absorb any torque or force exerted upon it. The openings can be formed in essentially any known way including but not limited to micro-machining, saw-cutting, laser cutting, casting, molding, chemically etching or treating, or other known methods and the like. In some embodiments, device 10 may include combinations of both complete and partial openings through the structure of device 10.

It will be apparent to those skilled in the art that various modifications and variations can be made to various embodiments described herein without departing from the spirit or scope of the teachings herein. Thus, it is intended that various embodiments cover other modifications and variations of various embodiments within the scope of the present teachings.

What is claimed is:

1. A device configured for use with a helmet, the device comprising:

a curved body being connected with the helmet and configured for disposal along a front part of a user's neck, said body comprising:

(i) a planar upper surfaces and a planar lower surface, said upper surface defining a slot; and (ii) an inwardly curved surface disposed between the planar surfaces configured for curved placement along the front part of the user's neck and configured to be spaced from the user's neck, wherein the device is configured to absorb an impact force and resist the user's neck from moving during a collision.

2. A device as recited in claim 1, wherein the helmet comprises a chin cup and the chin cup is disposed in the slot.

3. A device as recited in claim 2, wherein the chin cup includes at least one fixation element attached with the body.

4. A device as recited in claim 2, wherein the chin cup includes one or more dowels fixed with the body.

5. A device as recited in claim 1, wherein the slot is arcuate.

6. A device as recited in claim 1, wherein the body includes at least one opening disposed with the slot and configured to receive a portion of the helmet for fixation therewith.

7. A device as recited in claim 1, further comprising a connecting member that connects the body with the helmet, the connecting member comprising one or more of an adherent material, tape, glue and hook/loop closures.

8. A device as recited in claim 7, wherein the connecting member comprises the adherent material and the adherent material comprises one or more of a cellophane, vinyl, acetate, polyethylene acrylic, butyl rubber, ethylene-vinyl acetate, natural rubber, a nitrile, silicone rubber, a styrene block copolymer, a vinyl ether and a tackifier.

9. A device as recited in claim 1, wherein the lower surface is substantially in contact with the user's shoulder protective gear during the collision and resists and/or prevents the user's neck from moving forward during the collision.

10. A device as recited in claim 1, wherein the body comprises a resilient material and the resilient material comprises one or more of a polyethylene foam, rubber, a cross-linked polyethylene foam, a polypropylene foam, a polyurethane foam, a polystyrene foam and silicone.

11. A device as recited in claim 10, wherein the resilient material further comprises an antimicrobial and/or antiseptic material.

12. A device as recited in claim 1, wherein the helmet comprises a face mask and a connecting member that connects the body with the face mask.

13. A device as recited in claim 12, wherein the connecting member comprises an adherent material, tape, glue and hook/loop closures, and the adherent material comprises one or more of a cellophane, vinyl, acetate, polyethylene acrylic, butyl rubber, ethylene-vinyl acetate, natural rubber, a nitrile, silicone rubber, a styrene block copolymer, a vinyl ether and a tackifier.

14. A device as recited in claim 1, further comprising a connecting member that connects the body with the helmet, wherein the connecting member comprises a strap disposed within a cavity formed within and through the curved body and along the first surface.

15. A device as recited in claim 14, wherein the strap comprises fasteners located at both of its ends.

16. A device as recited in claim 1, further comprising a covering to provide additional strength to the device.

17. A device as recited in claim 16, wherein the covering comprises a vinyl material.

18. A device for use with a helmet in contact sports, the device comprising:

a curved body being connected with the helmet and configured for disposal along a front part of a user's neck, said body comprising:

(i) a flat upper surface and a flat lower surface, said upper surface defining an arcuate slot for disposal of a chin cup;

(ii) an inwardly curved surface disposed between the flat surfaces configured for curved placement along the front part of the user's neck and configured to be spaced near but does not contact the user's neck during normal use of the device; and (iii) a connecting member extending from the chin cup and being configured to connect the device to the user's helmet comprising one or more of an adherent material, tape, glue and hook/loop closures, wherein the device is configured to absorb an impact force and resist the user's neck from moving forward during said collision.

19. A protective apparatus for use in contact sports, the protective apparatus comprising:

a helmet including a chin cup; and a device comprising a curved body connected to the chin cup and configured for disposal along a front part of a user's neck, said body comprising:

(i) planar upper surface and a planar lower surface, said upper surface defining a slot for disposal of the chin cup;

(ii) an inwardly curved surface disposed between the planar surfaces configured for curved placement along the front part of the user's neck and configured to be spaced from but does not contact the user's neck during normal use of the device;

wherein the protective apparatus prevents an injury to the user's head and neck during a sports collision, and the device is configured to absorb an impact force during the sports collision.

20. A device as recited in claim 1, wherein the inwardly curved surface is concave.

* * * * *